United States Patent [19]

Nishikawa et al.

[11] Patent Number: 4,546,334

[45] Date of Patent: Oct. 8, 1985

[54] ELECTRICAL FILTER DEVICE

[75] Inventors: Toshio Nishikawa, Nagaokakyo; Youhei Ishikawa, Kyoto; Tadahiro Yorita, Nagaokakyo, all of Japan

[73] Assignee: Murata Manufacturing Co., Ltd., Japan

[21] Appl. No.: 487,095

[22] Filed: Apr. 21, 1983

[30] Foreign Application Priority Data

| | | | |
|---|---|---|---|
| Apr. 24, 1982 | [JP] | Japan | 57-70154 |
| Jun. 8, 1982 | [JP] | Japan | 57-98875 |
| Jul. 7, 1982 | [JP] | Japan | 57-118890 |
| Oct. 20, 1982 | [JP] | Japan | 57-184976 |
| Nov. 4, 1982 | [JP] | Japan | 57-194170 |
| Jan. 6, 1983 | [JP] | Japan | 58-506[U] |

[51] Int. Cl.[4] ..... H01P 1/202; H01P 1/205

[52] U.S. Cl. ..... 333/206; 333/24 C; 333/222; 333/245

[58] Field of Search ..... 333/202–212, 333/126, 134, 24 C, 222, 245

[56] References Cited

U.S. PATENT DOCUMENTS

| | | | |
|---|---|---|---|
| 3,221,847 | 2/1964 | Pakan | 333/134 |
| 4,151,494 | 4/1979 | Nishikawa et al. | 333/204 |
| 4,223,287 | 9/1980 | Nishikawa et al. | 333/206 |
| 4,245,198 | 1/1981 | Nishikawa et al. | 333/134 |
| 4,276,525 | 6/1981 | Nishikawa et al. | 333/206 |
| 4,342,972 | 8/1982 | Nishikawa et al. | 333/206 |
| 4,431,977 | 2/1984 | Sokola et al. | 333/222 |

*Primary Examiner*—Marvin L. Nussbaum

*Attorney, Agent, or Firm*—Ostrolenk, Faber, Gerb & Soffen

[57] ABSTRACT

An improved electrical filter device in which cut-off spaces required in a casing of the electrical filter device are still further reduced than in conventional arrangements, and which is free from unnecessary coupling and capable of being constructed entirely by capacitor coupling for compact size.

8 Claims, 26 Drawing Figures

ELECTRICAL FILTER DEVICE

BACKGROUND OF THE INVENTION

The present invention generally relates to a filter device and more particularly, to an electrical filter device such as an electrical filter, transmit-receive branching filter (a so called dupler) or the like which employs at least two dielectric coaxial resonators each including a dielectric member provided between an outer conductor and an inner conductor, and which may be used, for example, in a transmission and reception system for a radio communication equipment.

Commonly, electrical filter devices constituted by coaxial resonators each having a dielectric member disposed between an outer and an inner conductors (referred to merely as dielectric coaxial resonators hereinbelow) may be broadly divided into two types, one type of which disclosed, for example, in Japanese Laid Open Patent Application Tokkaisho No. 56-57302 has the construction shown schematically in FIG. 1, while the other type of which disclosed, for example, in Japanese Laid Open Patent Application Tokkaisho No. 56-57304 has the construction shown schematically in FIG. 2.

In the conventional arrangement as shown in FIG. 1, since inner conductors of respective $\frac{1}{4}$ wavelength dielectric coaxial resonators R are coupled, to each other by coupling capacitors C which are disposed between the inner conductors of respective neighboring dielectric coaxial resonators R, it is necessary to provide a cut-off space S at the open end side (where voltage distributed within the resonator has a maximum reduction in current) of each of the dielectric coaxial resonators R.

In the above arrangement, the capacitors C and lines connecting said capacitors C to each other form an imaginary signal propagation passage P as shown by two-dotted chain lines in the drawings. The dimensions and configurations of the cut-off space S referred to above are chosen to avoid coupling between the neighboring dielectric coaxial resonators R by electromagnetic waves, and therefore, the respective neighboring coaxial resonators R are coupled to each other only by the capacitors C. Nevertheless, there are cases where unnecessary coupling takes place due to leakage signal components propagated along inner surface of a casing (not shown). Moreover, each cut-off space S is inevitably required for one dielectric coaxial resonator R, thus making it difficult to make a device having a against compact size.

Meanwhile, in the known arrangement as shown in FIG. 2, the direction of the signal propagation passage P is arranged to be aligned with the axial direction of $\frac{1}{4}$ wavelength dielectric coaxial resonators R, while the open ends of the resonators R are coupled to each other by capacitors C, with short-circuit ends of the respective resonators R being magnetically coupled as shown. Although the cut-off spaces S are still required at the open end sides of the dielectric coaxial resonators R in a manner similar to that of the arrangement of FIG. 1, since one cut-off space S may be commonly used for the two confronting resonators R, the casing for the arrangement can be made compact by that extent, with a less possibility of occurrence of unnecessary coupling. However, in the case where an electrical filter is to be constructed, it becomes necessary to partly employ the induction (i.e. magnetic) coupling which is more complicated in structure than the capacitor coupling, and if the filter is entirely constructed by the capacitor coupling, it is required to partly employ $\frac{1}{2}$ wavelength dielectric coaxial resonators, thus being inconsistent with the requirement for the compact size.

SUMMARY OF THE INVENTION

Accordingly, an essential object of the present invention is to provide an electrical filter device in which cut-off spaces required in a casing of the electrical filter device are reduced relative to conventional arrangements, and which is free from unnecessary coupling and capable of being constructed entirely with capacitive coupling for compact size.

Another important object of the present invention is to provide an electrical filter device of the above described type in which respective resonators are provided with simple and inexpensive terminal members not requiring high dimensional accuracy.

A further object of the present invention is to provide an electrical filter device of the above described type which is simple in construction and accurate in functioning at high reliability, and can be readily manufactured on a large scale at low cost.

In accomplishing these and other objects, according to one preferred embodiment of the present invention, there is provided an electrical filter device which includes at least two or more dielectric coaxial resonators each having a dielectric member provided between an inner and an outer conductors, a propagation passage for propagating a signal therethrough, and capacitors for coupling said dielectric coaxial resonators to each other. The dielectric coaxial resonators are divided to be disposed at opposite sides of the signal propagation passage so as to confront each other at open end sides thereof, through the signal propagation passage for commonly utilizing one cut-off space by the two dielectric coaxial resonators confronting each other through said signal propagation passage, with the dielectric coaxial resonators being coupled to each other by the capacitors.

By the arrangement according to the present invention as described above, a compact electrical filter device which functions accurately has been advantageously presented through simple construction, with substantial elimination of disadvantages inherent in the conventional electrical filter devices of this kind.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
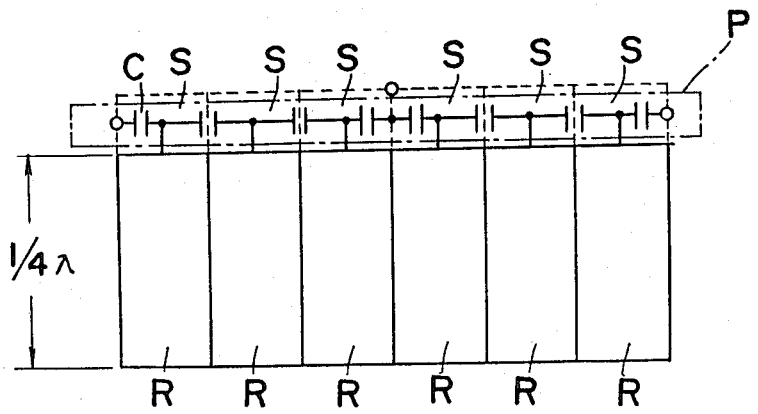
Fig. 1 PRIOR ART
FIG. 1 is a schematic diagram showing construction of one type of a conventional electrical filter device (already referred to)
Figure 2:
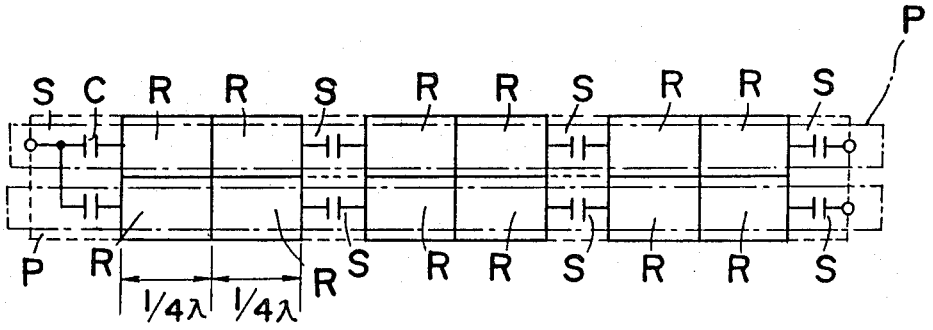
Fig. 2 PRIOR ART
FIG. 2 is a schematic diagram showing construction of another type of a conventional electrical filter device (already referred to)

Before the description of the present invention proceeds, it is to be noted that like parts are designated by like reference numerals throughout the accompanying drawings.

Figure 3:
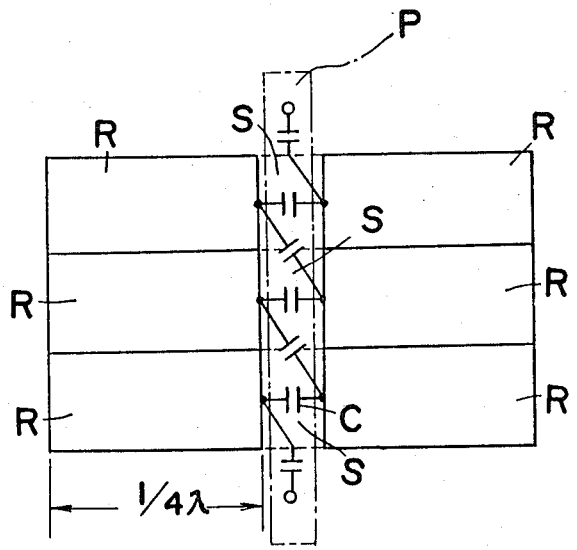
FIG. 3 is a schematic diagram showing a basic arrangement of an electrical filter device according to the present invention.

Referring now to the drawings, there is shown in FIG. 3, a schematic diagram showing a basic concept for an electrical filter device according to the present invention, in which $\frac{1}{4}$ wavelength dielectric coaxial resonators R utilizing coaxial TEM mode resonance are divided so as to be arranged at opposite sides of a signal propagation passage P so that open ends of said resonators R confront each other through the propagation passage P for commonly utilizing one cut-off space S by the confronting two dielectric coaxial resonators R, with respective stages of the filter being connected to each other through capacitors C for capacitor coupling which is more advantageous than the induction coupling.

By the construction described above, an extremely rational arrangement is achieved to provide a compact electrical filter device free from unnecessary coupling and suitable for a mass production.

Figure 4:
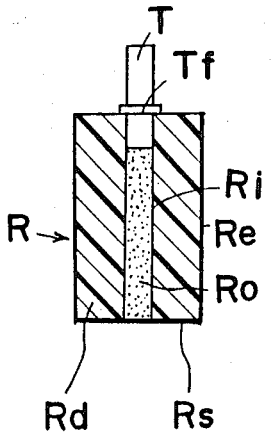
FIG. 4 is a side sectional view showing, on an enlarged scale, construction of a known dielectric coaxial resonator which may be employed in the arrangement of FIG. 3.

Each of the $\frac{1}{4}$ wavelength dielectric coaxial resonators R itself to be employed in the above arrangement may be of a known construction as shown in FIG. 4, which includes a cylindrical member Rd of a circular or rectangular cross section, etc., having a central bore Ro, partially filled, for example, with a ceramic dielectric material of titanium oxide group, an inner conductor Ri and an outer conductor Re respectively formed on the inner wall surface of the central bore Ro and the outer peripheral surface of the cylindrical member Rd by baking silver paste thereonto or by electroless copper plating, an electrode layer Rs formed in the similar manner on the entire bottom surface of the cylindrical member Rd for short-circuiting between the inner conductor Ri and the outer conductor Re, and a metallic rod-like terminal member T having a flange portion Tf acting as a stopper and inserted into the upper portion of the central bore Ro from its open end, with the terminal member T and the inner conductor Ri being bonded to each other, for example, by an electrically conductive bonding agent (not shown).

It should be noted here that the structure of the terminal member is not limited to that of the terminal member T as described above, but may be modified in various ways, for example, as in terminal member TB or TC described later with reference to FIGS. 21 to 24.

Figure 5:
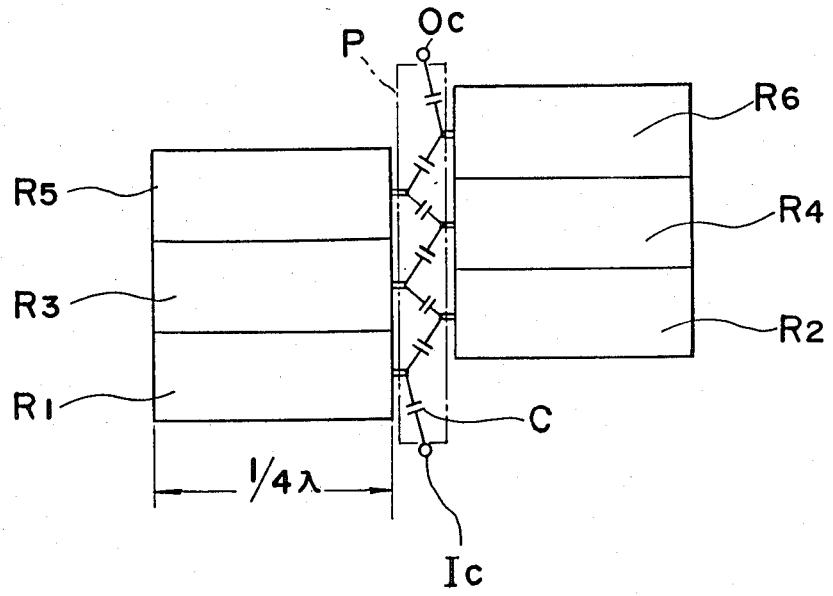
FIG. 5 is a diagram similar to FIG. 3, which particularly shows another basic arrangement thereof.

Referring also to FIG. 5, there is shown another basic arrangement for an electrical filter according to the present invention.

In the arrangement of FIG. 5, three dielectric coaxial resonators R utilizing the coaxial TEM mode are provided at each side of the signal propagation passage P as shown, while the respective resonators R are coupled to each other in such a manner that the resonator R1 at the first stage is connected to the resonator R2 at the second stage, the resonator R2 to the resonator R3 at the third stage, the resonator R3 to the resonator R4 at the fourth stage, the resonator R4 to the resonator R5 at the fifth stage, and the resonator R5 to the resonator R6 at the last stage, with the open ends of the resonators R1 to R6 being arranged to confront each other diagonally slantwise, and capacitors C are connected between the resonator R1 at the first stage and an input connector Ic, the resonator R6 at the last stage and an output connector Oc, and also between the respective stages as shown. For the capacitors C, discrete capacitor parts may be used, but composite capacitor parts each having a plurality of electrodes provided on one dielectric base plate as described later with reference to FIGS. 18 to 20 may also be employed.

In the arrangement of FIG. 5 as described above, the dielectric coaxial resonators R are divided to be disposed at opposite sides of the signal propagation passage P so that the open end of the resonator at a n-th stage (n is a natural number) and that of the resonator at a stage (n+1)-th diagonally confront each other, with the respective resonators R being coupled to each other through capacitors. Therefore, as compared with the arrangement in which the resonator at the n-th stage and the resonator at the (n+1)-th stage are adapted to axially confront each other at the open ends thereof, unnecessary coupling between the resonators is advantageously eliminated, since the resonator at the n-th stage is further spaced in distance from the resonator at a stage of (n+3)-th.

Figure 6:
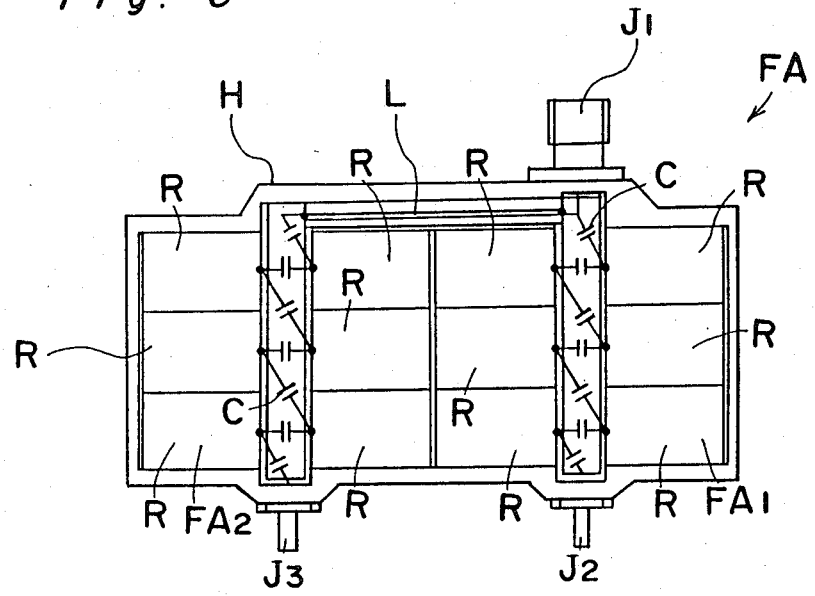
FIG. 6 is a schematic diagram showing an internal construction of an electrical filter device according to one preferred embodiment of the present invention.
Figure 7:
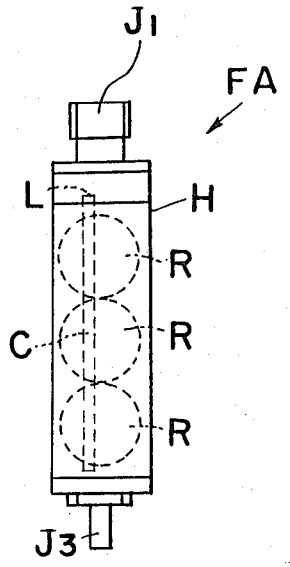
FIG. 7 is a schematic side elevational view of the electrical filter device of FIG. 6.

Referring further to FIGS. 6 and 7, there is shown an electrical filter FA according to one preferred embodiment of the present invention.

In FIGS. 6 and 7, the electrical filter FA generally includes a casing H, a first filter portion FA1 at the right side half of the filter FA having six dielectric coaxial resonators R arranged as described with reference to FIG. 3, a second filter portion FA2 at the left side half also having six dielectric coaxial resonators R disposed also in the manner as described with reference to FIG. 3, with the second filter portion FA2 being connected to the first filter portion FA1 through a line L such as a coaxial cable, strip line or the like, an input/output connector J1 commonly used for the first and second filter portions FA1 and FA2, another input/output connector J2 exclusive for the first filter portion FA1, a further input/output connector J3 exclusive for the second filter portion FA2, and coupling capacitors C, for example, in the form of a composite capacitor part to be mentioned later, provided for connecting the neighboring resonators R to each other in the first and second filter portions FA1 and FA2.

Figure 8:
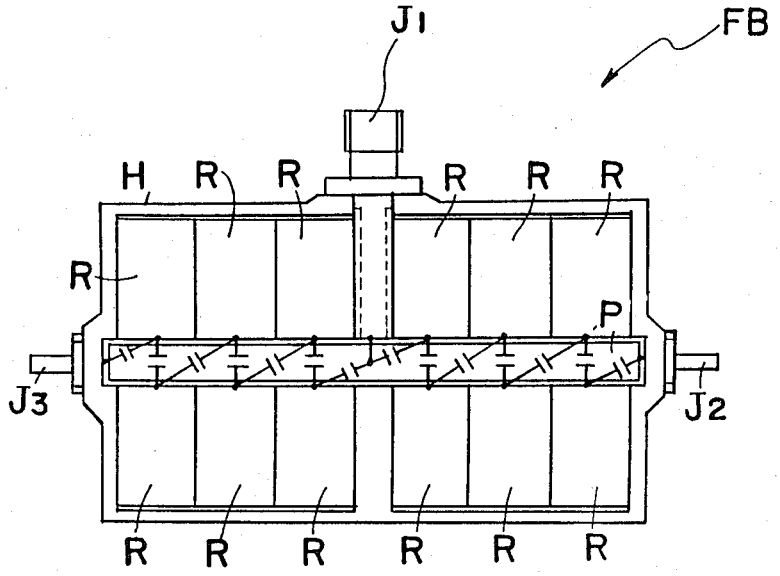
FIG. 8 is a schematic diagram showing an internal construction of an electrical filter device according to a second embodiment of the present invention.
Figure 9:
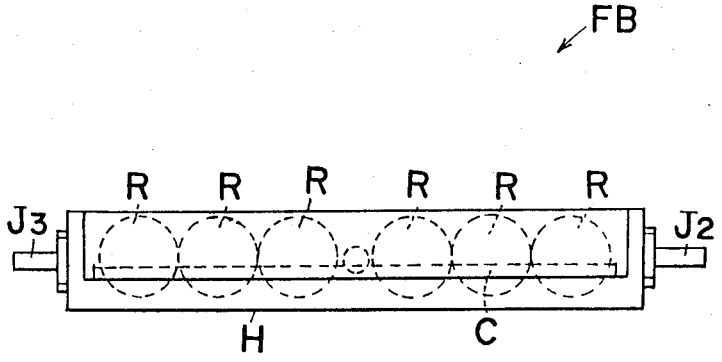
FIG. 9 is a schematic side elevational view of the electrical filter device of FIG. 8.

Referring further to FIGS. 8 and 9, there is shown a modification of the electrical filter device FA of FIGS. 6 and 7. In the modified electrical filter device FB of FIGS. 8 and 9, the dielectric coaxial resonators R in each of the first and second filter portions FA1 and FA2 described as arranged horizontally to confront each other through the signal propagation passage P in the arrangement of FIGS. 6 and 7, are modified to be arranged vertically to confront each other through the signal propagation passage P in the casing H as shown, and the connector J1 is disposed on one center line or vertical axis of the casing H, while the connectors J2 and J3 are provided on another center line or horizontal axis of the casing H. Since other construction and effect of the electrical filter device FB of FIGS. 8 and 9 are generally similar to those of the filter device FA of FIGS. 6 and 7, detailed description thereof is abbreviated for brevity, with like parts being designated by like reference numerals.

Although not particularly shown, further modifications, for example, a modification in which the first and second filter portions are overlapped each other, may be conceived to provide the same function and effect as in the foregoing embodiments.

As is seen from the foregoing description, in the embodiments of FIGS. 6 to 9, it is so arranged that, in the electrical filter employing at least more than two dielectric coaxial resonators each including the dielectric member disposed between the inner and outer conductors, the resonators are divided to be disposed at the opposite sides of the signal propagation passage, with the open ends thereof confronting each other so that one cut-off space may be commonly utilized by the two resonators facing each other through the signal propagation passage, and with the resonators being coupled with each other through the capacitors, and therefore, compact size of the arrangement may be achieved owing to the minimum cut-off space required, while the unnecessary coupling is not readily produced owing to the employment of the simple capacitor coupling.

Figure 10:
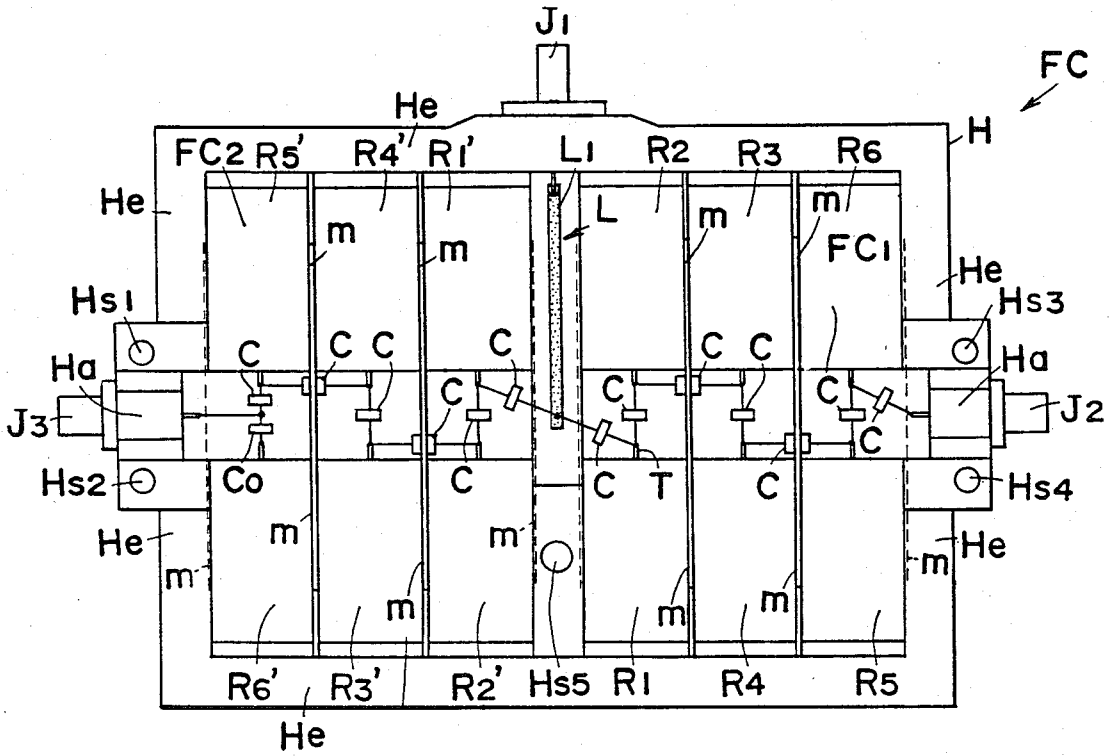
FIG. 10 is a schematic diagram showing an internal construction of an electrical filter device according to a third embodiment of the present invention.

Referring further to FIGS. 10 through 17, there is shown in FIG. 10, an electrical filter FC according to another modification of the present invention.

In FIG. 10, the filter FC includes the casing H, a first filter portion FC1 at the right side half of the filter FC having six dielectric coaxial resonators R1 to R6 arranged in the manner as in FIGS. 3, and a second filter portion FC2 at the left side half also having six dielectric coaxial resonators R1′ to R6′ arranged as in FIG. 3. It is to be noted that, in the above arrangement, the second filter portion FC2 differs in construction from the first filter portion FC1 in that a trap composed of one capacitor and the dielectric coaxial resonator is added to the band-pass type filter of five stages, although it is needless to say that the first and second filter portions FC1 and FC2 can take any construction desired as needed. At the central portion on one longitudinal side face of the casing H, the input/output connector J1 commonly used for the first and second filter portions FC1 and FC2 is provided, while at the central portion on one of the widthwise side faces of the casing H, the input/output connector J2 exclusive for the first filter portion FC1 is provided, and at the central portion on the other widthwise side faces thereof, another input/output connector J3 exclusive for the second filter portion FC2 is disposed, with the strip line L extending from the connector J1 into the casing H up to the centeral portion thereof. The strip line L may of course be in the form of a coaxial line.

Figure 11:
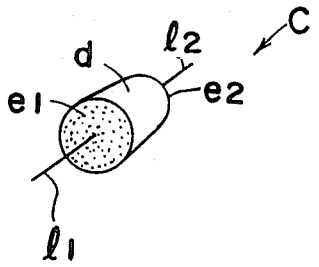
FIG. 11 is a schematic perspective view, on an enlarged scale, of a capacitor which may be employed in the arrangement of FIG. 10.
Figure 20:
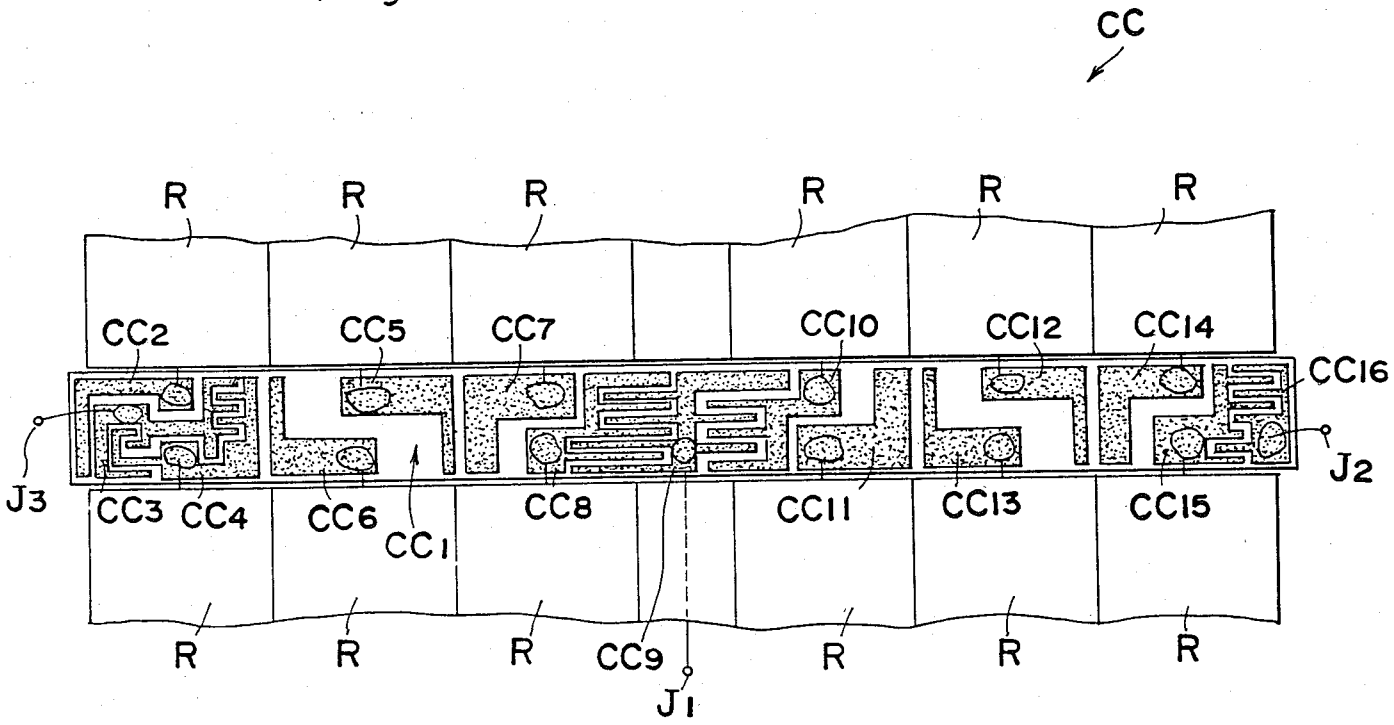

For the coupling capacitors C employed in the first and second filter portions FC1 and FC2 in the above arrangement of FIG. 10, there may be employed, for example, a discrete capacitor C as shown in FIG. 11, which includes a cylindrical dielectric member d of titanium oxide group, electrodes e1 and e2 provided on opposite end faces of the dielectric member d, and lead wires l1 and l2 respectively connected to the electrodes e1 and e2, although such capacitors C can be replaced, for example, by a composite capacitor part CC to be described later with reference to FIG. 20.

Figure 12:
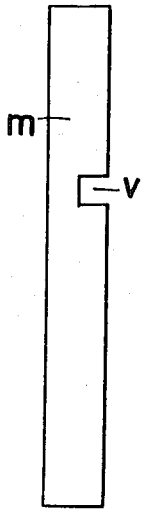
FIG. 12 is a front elevational view, on an enlarged scale, of a metallic shield plate employed in the arrangement of FIG. 10.

In the arrangement of FIG. 10, between the respective neighboring coaxial resonators R, there are inserted metallic shield plates m as shown in FIG. 12, each having a width and a length sufficient to extend from one resonator to the corresponding resonator confronting each other at the open ends thereof through the cut off space so as to provide a shielding function. Each plate is formed with an opening or notch V for allowing a coupling capacitor C to be disposed therethrough. The metallic shield plates m may further be provided between the exclusive input/output connectors J2 and J3 and the resonators R neighboring said connectors, and also between the strip line L and the resonators R disposed adjacent thereto as shown in dotted lines in FIG. 10, or may be integrally formed with the casing H.

Figure 13:
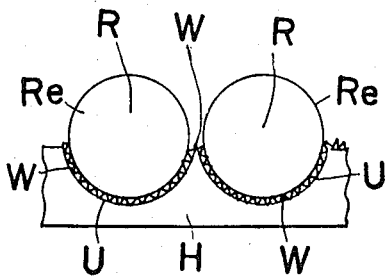
FIG. 13 is a schematic diagram explanatory of a structure for mounting dielectric coaxial resonators which may be employed in the arrangement of FIG. 10.
Figure 14:
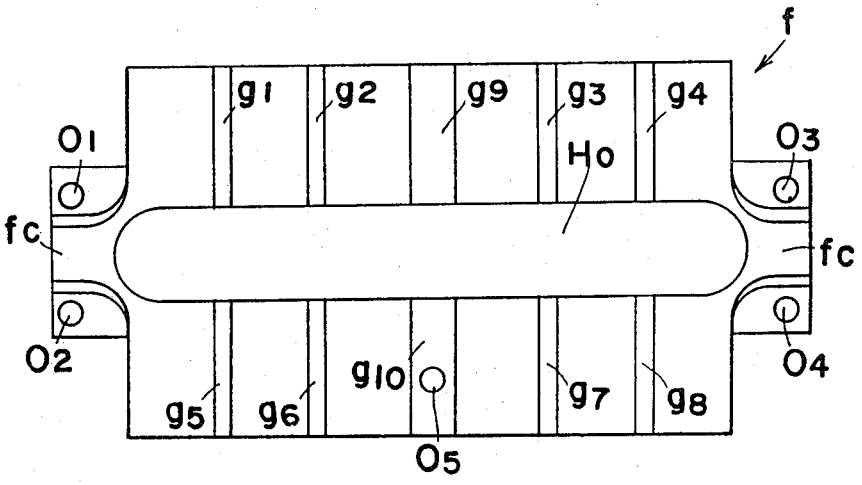
FIG. 14 is a top plan view of a metallic pressure plate employed in the arrangement of FIG. 10.
Figure 15:
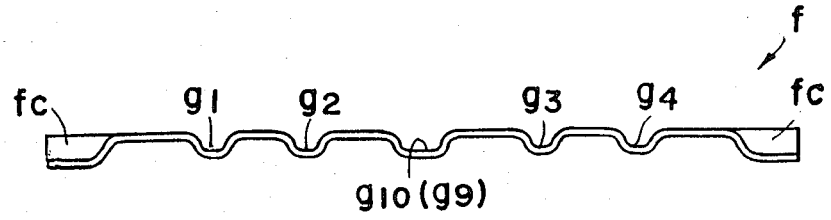
FIG. 15 is side elevational view of the metallic pressure plate of FIG. 14.

In the electrical filter FC of FIG. 10, the dielectric coaxial resonators R are fixedly mounted in the casing H in a manner as most clearly seen in FIG. 13. More specifically, in the bottom surface in the casing H, semicircular recesses u whose cross sections conform with the peripheral faces of the respective resonators R, are formed, with wire meshes W being disposed between the surfaces of the resonators R and the recesses u. In other words, the surfaces of the recesses u and the outer conductors Re of the respective resonators R are bonded to each other through spaces of meshes of the wire meshes W by an electrically non-conductive bonding agent (not shown), for example, of an epoxy group as needed, and thereafter, electrical conduction between the surfaces of the recesses u and the outer conductors Re of the respective resonators R is established through the wire meshes W. In the above arrangement, it is preferable that wires constituting the wire mesh W be sufficiently bent in the direction of thickness of said wire mesh W for an improved cushioning effect so as to provide a still greater positive electrical conduction. It should be noted here that the length of the wire mesh W need not necessarily be equal to the axial length of the resonator R, but the wire meshes W may be arranged to be partially present at the side of the open ends of the respective resonators R. The central conductor of the common input/output connector J1 is connected to one end of the central conductor L1 of the strip line L, while the other end of said central conductor L1 is connected to the terminal T of the resonator R1 at the first stage of the first filter portion FC1 through the first coupling capacitor C. The terminal T of the resonator R1 at the first stage is connected to the terminal T of the resonator R2 at the second stage (the open end of the resonator R1 at the first stage confronts the open end of the corresponding resonator R2) through the second coupling capacitor C, and the terminal T of the resonator R2 at the second stage is connected to the terminal T of the resonator R3 at the third stage (which is disposed side by side adjacent to the resonator R2 at the second stage) through the third capacitor C, which is located within the notch V of the metallic shield plate m described earlier. Meanwhile, the resonators R3 and R4 at the third and fourth stages are coupled to each other in the similar manner as in the resonators Rl and R2 at the first and second stages, the resonators R4 and R5 at the fourth and fifth stages in the similar manner as in the resonators R2 and R3 in the second and third stages, the resonators R5 and R6 at the fifth and sixth stages in the similar manner as in the resonators R1 and R2 at the first and second stages described earlier, and the terminal T of the resonator R6 at the sixth stage is connected to the central conductor of the connector J2 through the coupling capacitor C. In the second filter portion FC2, although the connections are generally similar to those in the first filter portion FC1, the terminal T of the dielectric coaxial TEM resonator R5' at the fifth stage is connected to the central conductor of the exclusive input/output connector J3 through the coupling capacitor C, and the terminal T of the resonator R6' equivalent to the resonator R6 at the sixth stage in the first filter portion FC1 is connected with the central conductor of the exclusive input/output connector J3 through the capacitor Co so as to function as a trap.

After the resonators R are accommodated for fixing in the casing H in the manner as shown in FIG. 13, and connected as described above, a pressure plate f as illustrated in FIGS. 14 and 15 is secured to the casing H by set screws. For this purpose, the casing H is formed with five threaded openings Hs1, Hs2, Hs3, Hs4 and Hs5, while the pressure plate f is also formed with five screw holes O1, O2, O3, O4 and O5 in the corresponding positions thereof. The metallic pressure plate f is formed, in the widthwise direction thereof, with groove portions g1, g2, g3, g4, g5, g6, g7 and g8 which are to be directed between the resonators R disposed side by side, and groove portions g9 and g10 to be located above the strip line L and its extension and provided with the screw hole O5, while, at the opposite short sides of said pressure plate f, there are formed cover portions fc which are to be fitted onto connector mounting portions Ha for the connectors J2 and J3 of the casing H. At the central portion of the pressure plate f, there is further formed an elongated opening Ho having dimensions sufficient to allow the coupling capacitors C to be attached or detached therethrough.

Figure 16:
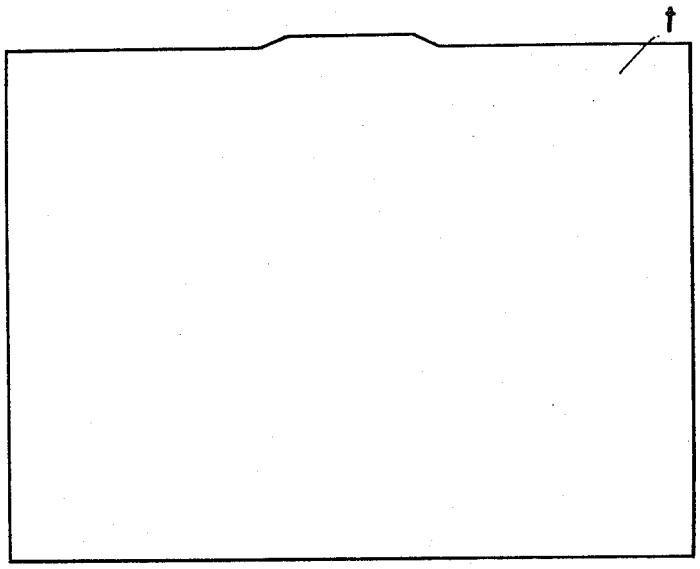
FIG. 16 is a top plan view of a metallic thin sheet employed in the arrangement of FIG. 10.
Figure 17:
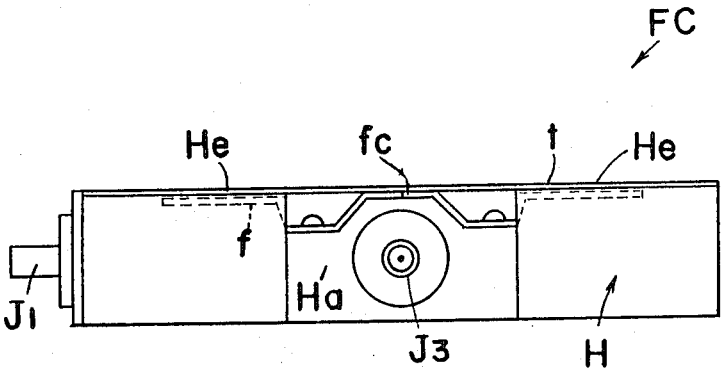
FIG. 17 is a side elevational view of the arrangement of FIG. 10, FIGS. 18 through 20 are top plan views of composite capacitor parts which may be employed in the electrical filters according to the present invention.

The mounting portions Ha of the connectors J2 and J3 for the casing H are arranged to extend laterally to a certain extent from the side edges of the casing H in FIG. 10, and to be lower at opposite sides thereof, than the upper edge He of the casing H as is most clearly seen in FIG. 17, with the threaded openings Hs1, Hs2, Hs3 and Hs4 being formed thereat to receive the set screws. The cover portions fc are processed to conform with the configurations at the above portions, and thus, upon fixing the pressure plate f itself on the casing H by the set screws, said plate f is positioned so as not to project above the upper edge He of the casing H. In the manner as described above, the outer conductors Re of the resonators R are conducted to the casing H through the wire meshes W, with the resonators R being fixed within the casing H. Subsequently, a metallic thin sheet t having dimensions conforming with the external configuration of the casing H as shown in FIG. 16 is applied onto the edges He of the casing H and the metallic pressure plate f (FIG. 17).

As is seen from the foregoing description, in the embodiments of FIGS. 10 to 17, it is so arranged that, in the electrical filter employing at least more than three dielectric coaxial resonators each including the dielectric member disposed between the inner and outer conductors, the resonators are divided to be disposed at the opposite sides of the signal propagation passage, with the open ends of said resonators confronting each other, so that one cut-off space may be commonly utilized by the two resonators facing each other through the signal propagation passage, and with the resonators being coupled to each other through the capacitors, while the shield walls or shield plates are provided between the neighboring resonators so as to couple the resonators to each other via the capacitors through openings or notches formed in said shield plates, and therefore, the cut-off space may be reduced to the necessary minimum for the compact size, with a marked reduction of unnecessary coupling through employment of the simple capacitor coupling construction.

Figure 18:
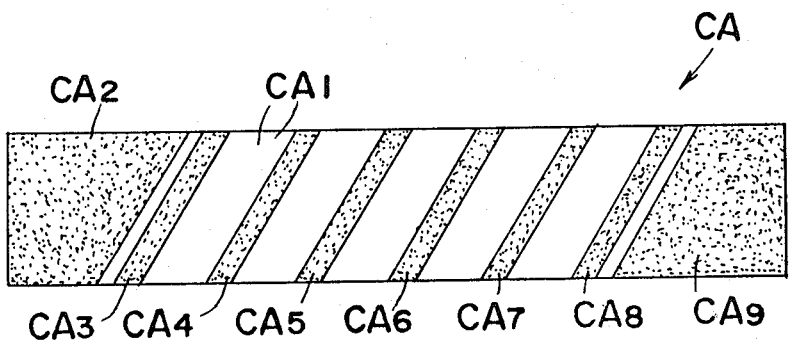
Figure 19:
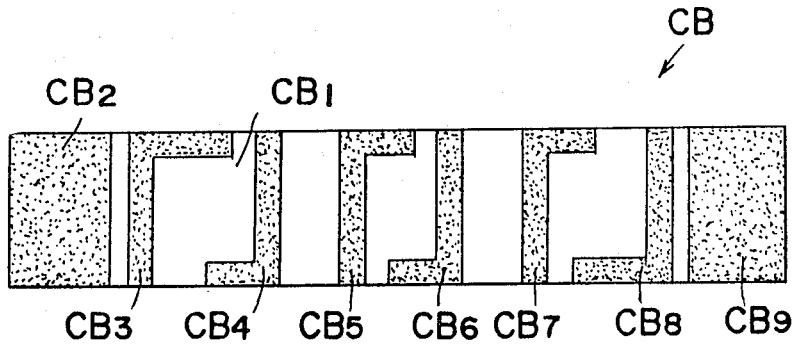

For the coupling capacitors C to be used in the first and second filter portions in the foregoing embodiments, although ordinary capacitors in the form of discrete parts may be adopted as described earlier, employment of a composite capacitor part CA, CB or CC as shown in FIGS. 18, 19 or 20 is more preferable for a still more compact size and simple construction.

The composite capacitor part CA shown in FIG. 18 includes a dielectric base plate CA1 made of a ceramic dielectric material or the like, and capacitor electrodes CA2, CA3, CA4, CA5, CA6, CA7, CA8 and CA9 provided on one surface of said dielectric plate CA1, and if applied to the first filter portion in the arrangement of FIGS. 6 and 7, central conductors of the connector J1 and strip line L are connected to the electrode CA2, the terminal T of the resonator R in a first stage at the upper side end portion in FIG. 6 is connected to the electrode CA3, the terminal T of the resonator R in a second stage at the lower side end portion is connected to the electrode CA4, the terminal T of the resonator R in a third stage at the upper side end portion is connected to the electrode CA5, the terminal T of the resonator R in a fourth stage at the lower side end portion is connected to the electrode CA6, the terminal T of the resonator R in a fifth stage at the upper end portion is connected to the electrode CA7, the terminal T of the resonator R in a sixth stage at the lower end portion is connected to the electrode CA8, and the connector J2 is coupled to the electrode CA9. For employment of the composite capacitor part CA in the second filter portion in FIG. 6, the central conductor of the strip line L is connected to the electrode CA2, the connector J3 is connected to the electrode CA9, and other connections are made in the similar manner as described above.

In the modified composite capacitor CB shown in FIG. 19 and including the dielectric base plate CB1, and capacitor electrodes CB2, CB3, CB4, CB5, CB6, CB7, CB8 and CB9, the electrode CB2 thereof corresponds in the function to the electrode CA2 of the composite capacitor part CA in FIG. 18, the electrode CB3 to the electrode CA3, the electrode CB4 to the electrode CA4, the electrode CB5 to the electrode CA5, the electrode CB6 to the electrode CA6, the electrode CB7 to the electrode CA7, the electrode CB8 to the electrode CA8 and the electrode CB9 to the electrode CA9.

The composite capacitor parts CA and CB described so far may further be modified, for example, as in the composite capacitor part CC shown in FIG. 20 and having electrodes CC2 to CC16 provided on the dielectric base plate CC1 for application, for example, to the electrical filter of FIG. 10, in which the electrode CC3 is connected to the connector J3, the electrode CC9 to the connector J1 and the electrode CC16 to the connector J2, with the other electrodes CC2, CC4, CC5, CC6, CC7, CC8, CC10, CC11, CC12, CC13, CC14 and CC15 being respectively connected to terminals T of the resonators R confronting each other at their open ends as shown. In the arrangement of FIG. 20, since the base plate CC1 is of one sheet material, electrostatic capacitance for each of the capacitors is mainly determined by the distance between the neighboring electrodes and the lengths of the confronting electrodes. It will be seen from FIG. 20 that the capacitors are formed to have larger electrostatic capacitance as they approach the connectors J1, J2 and J3 for the improvement of the filter characteristics.

As described above, the capacitor electrodes may take any configuration so as to provide necessary electrostatic capacitance as desired.

As described previously, the structure of the terminal member T for each of the resonators R may be varied in various ways, for example, as in modifications thereof shown in FIGS. 21 to 24.

Figure 21:
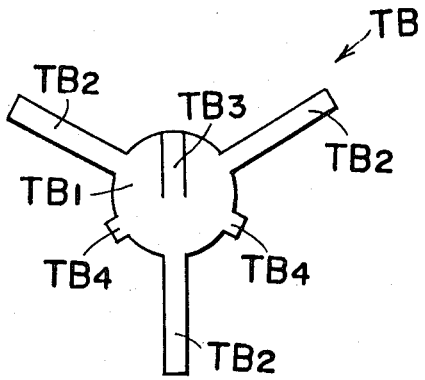
FIGS. 21 through 23 are respectively a top plan view, a rear side view and a side elevational view explanatory of formation of a terminal member for the dielectric coaxial resonator which may be employed in the electrical filter according to the present invention.
Figure 22:
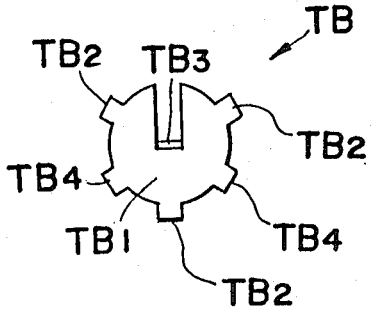
Figure 23:
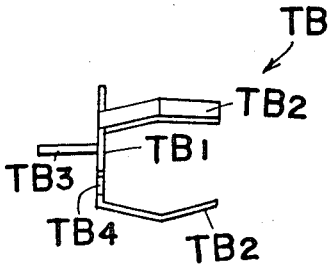

In FIGS. 21 to 23, the modified terminal member TB includes a plate-like or disc-like portion TB1, a plurality of tongue-like contact portions, for example, three contact portions TB2 extending radially outwardly from the peripheral edge of the disc-like portion TB1, a connecting portion or lug TB3 formed by cutting part of the disc-like portion TB1 towards its center, and a plurality of stopper projections, for example, two stopper projections TB4, radially outwardly extending from the peripheral edge of the disc-like portion TB1 to a necessary minimum extent, all of which are integrally formed with said disc-like portion TB1. Each of the contact portions TB2 is folded through about 90° with respect to the surface of the disc-like portion TB1 and is further bent outwardly into a V-shape at its central portion for resiliency (FIG. 23), while the connecting lug TB3 is folded in a direction opposite to that of the contact portions TB2, with respect to the disc-like portion TB1 (FIGS. 22 and 23). When the contact portions TB2 of the terminal member TB are inserted into the central bore Ro of the dielectric coaxial resonator R (FIG. 4), said contact portions TB2 are pressed against the peripheral wall of the inner conductor Ri for securing of the terminal member TB thereat, and the connecting lug TB3 used for the external connection, for example, for connection with a capacitor electrode by soldering, is rigidly fixed between neighboring resonators through the capacitor C, and thus, there is no possibility that the terminal member TB comes off the resonator R. It is to be noted here that the configuration and the number of the contact portions TB2, connecting lug TB3 and stopper projections TB4, etc. of the terminal member TB are not limited to those in FIGS. 21 to 23, but may be modified in various ways within the scope, for example, as in the further modified terminal member TC in FIG. 24, in which the connecting lug TB3 described as formed in the terminal member TB in FIGS. 21 to 23 is replaced by another stopper projection TC4, while other constructions are generally similar to the terminal member TB of FIGS. 21 to 23.

Figure 25:
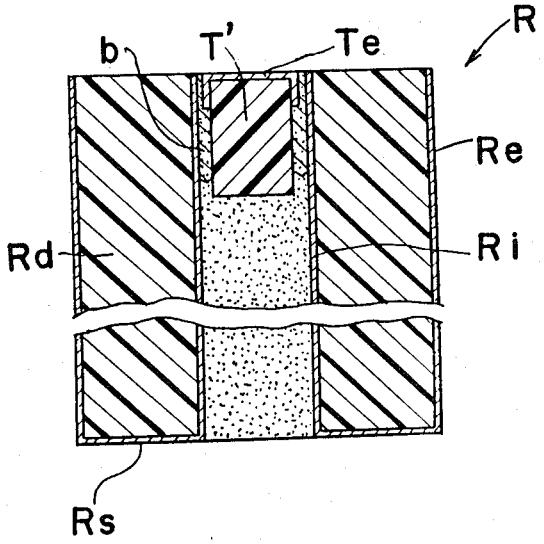
Fig. 25 PRIOR ART
FIG. 25 is a fragmentary side sectional view of a conventional dielectric coaxial resonator particularly showing the structure at its terminal portion.

Incidentally, another conventional arrangement for external connection of the inner conductor Ri of the resonator R has been such that, as shown in FIG. 25, the cylindrical terminal member T' formed with an electrode Te, for example, at its upper surface and part of its peripheral surface, is cut into a predetermined length and inserted into the upper portion of the inner conductor Ri so as to be bonded to said inner conductor Ri by an electrically conductive bonding material b or through baking by silver paste. However, in the known practice as described above, there have been such disadvantages that, it has been further required to position the upper surface of the terminal member T' to be flush with the open end surface of the resonator R, and in this case, since the terminal member T' is of a mere cylindrical configuration without any stopper portion in the above positioning, its position tends to be deviated during bonding, thus resulting in projection or retreatment of said terminal member T' with respect to the open end face of the resonator R.

Figure 24:
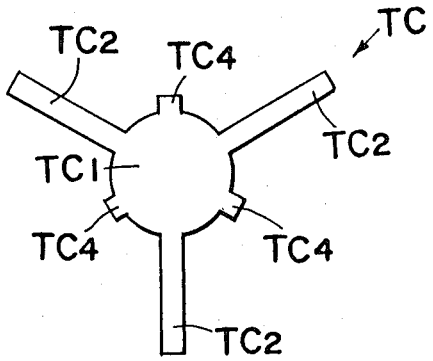
FIG. 24 is a top plan view similar to FIG. 21, which particularly shows a modification thereof.
Figure 26:
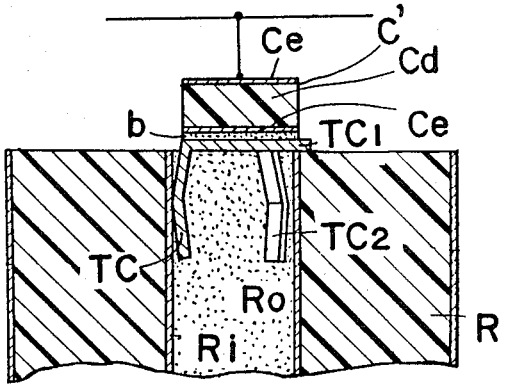
FIG. 26 is a view similar to FIG. 25, which particularly shows the structure at the terminal portion of the dielectric coaxial resonator in which the terminal member, for example, of FIG. 24 is employed.

In contrast, in the case where the terminal member TB or TC, for example, the terminal member TC described with reference to FIG. 24 of the present invention is employed, upon insertion of the contact portions TC2 having the resiliency into the central bore Ro of the resonator R as shown in FIG. 26, such contact portions TC2 are brought into pressure contact with the inner conductor Ri. On the disc-like portion TC1 of the terminal member TC thus inserted into the inner conductor Ri, for example, a capacitor C' formed by a cylindrical ceramic dielectric member Cd and electrodes Ce formed on opposite end faces thereof, is fixed by soldering or by the electrically conductive bonding material b. Thus, in the region where the resonator R has inductivity, a series resonance is formed through combination thereof with the capacitor C', thereby to constitute a trap device. It should be noted here that in the case where there is a possibility that the inner conductor R is separated during the bonding due to different thermal expansion coefficients at various parts, for example, when the inner conductor Ri is of copper plating, the terminal member TB or TC of the present invention is particularly effective, since the contact portions TB2 or TC2 advantageously absorb the strain resulting from the difference in the thermal expansion coefficients.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. An electrical filter device, comprising:

first and second groups of dielectric coaxial resonators, each said group including a plurality of resonators, each said resonator including a cylindrical coaxial member having coaxial inner and outer surfaces and inner and outer conductors formed on said inner and outer surfaces, respectively;

each resonator of said first group being adjacent at least one other resonator of said first group and having at open end face which is approximately located in a first common imaginary plane;

each resonator of said second group being adjacent at least one other resonator of said second group and having an open end face which is approximately located in a second common imaginary plane spaced from and generally parallel to said first imaginary plane to define a signal propagation passage therebetween with said open faces of each of said resonators facing said signal propagation passage, said first and second groups of resonators at least partially overlapping one another;

the dimensions of said signal propagation passage being sufficient to ensure that there is substantially no electronic coupling between said resonators through said signal propagation passage; and capacitor means located in said signal propagation passage for capacitively coupling all of said resonators together.

2. An electrical filter device as claimed in claim 1, further including a plurality of shield plates, each said shield plate extending through said signal propagation passage and being located between a respective adjacent pair of resonators of said first group and a respective adjacent pair of resonators of said second group, each of said shield plates having an opening formed therein and through which said capacitor means extends.

3. An electronic filter device as claimed in claim 1, wherein said open faces of said resonators of said first group diagonally confront said open faces of said second group.

4. An electrical filter device as claimed in claim 1 or 2, further including input and output terminals connected to said capacitor means, the capacitor of said capacitor means increasing as said capacitor means gets closer to said input and output terminals.

5. An electrical filter device as claimed in claim 1 or 2, wherein said capacitor means is a plurality of discrete capacitors.

6. An electrical filter device as claim in claim 1 or 2, wherein said capacitor means is a composite capacitor part including a base plate formed of a dielectric material and capacitor electrodes formed on one surface of said base plate. as 7. An electrical filter device as claimed in claim 1 or 2, wherein each of said dielectric coaxial resonators has a terminal member coupled to its inner conductor and covering said open end side thereof, said terminal member including a plate-like portion, a plurality of tongue-like contact portions extending radially outwardly from a peripheral edge of said plate-like portion and folded in one direction with respect to the plate-like portion, and stopper portions extending radially outwardly from the peripheral edge portion of said plate-like portion to a predetermined distance, said tongue-like contact portions extending into a central opening of said resonator, said opening being defined by said inner surface of said cylindrical coaxial member, and said tongue-like contact portions being in pressure contact with said inner conductor, said capacitor means being coupled to each said resonator via its said terminal member.

8. An electrical filter device as claimed in claim 7, wherein each said terminal member is further formed with a connecting lug formed by cutting in said plate-like portion towards its central portion and foldingsaid cut portion in a direction opposite to the folding direction of said tongue-like contact portions.

* * * * *